US007753488B2

(12) United States Patent
Imai

(10) Patent No.: US 7,753,488 B2
(45) Date of Patent: Jul. 13, 2010

(54) INK-JET RECORDING APPARATUS

(75) Inventor: Koji Imai, Inuyama (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 703 days.

(21) Appl. No.: 11/803,078

(22) Filed: May 11, 2007

(65) Prior Publication Data

US 2007/0263053 A1 Nov. 15, 2007

(30) Foreign Application Priority Data

May 12, 2006 (JP) ..... 2006-133688

(51) Int. Cl.
*B41J 2/14* (2006.01)
*B41J 2/175* (2006.01)

(52) U.S. Cl. ..... 347/49; 347/50; 347/85; 347/86

(58) Field of Classification Search ..... 347/49, 347/50, 66, 68, 85, 86
See application file for complete search history.

(56) References Cited

U.S. PATENT DOCUMENTS 6,099,111 A * 8/2000 Chang ..... 347/71
6,863,390 B2 * 3/2005 Arai et al. ..... 347/94
7,168,795 B2 1/2007 Shimizu
7,438,371 B2 * 10/2008 Silverbrook et al. ..... 347/9
7,540,596 B2 * 6/2009 Hiwada ..... 347/71
2005/0140741 A1 6/2005 Kubo

FOREIGN PATENT DOCUMENTS

| | | |
|---|---|---|
| JP | 2001-219560 | 8/2001 |
| JP | 2002-067312 | 3/2002 |
| JP | 2005-125636 | 5/2005 |
| JP | 2005-161571 | 6/2005 |
| JP | 2005-178306 | 7/2005 |

* cited by examiner

*Primary Examiner*—Anh T. N. Vo
(74) *Attorney, Agent, or Firm*—Eugene LeDonne; Joseph W. Treloar; Frommer Lawrence & Haug LLP

(57) ABSTRACT

An ink-jet recording apparatus includes an ink supplying member which has an ink storage section, an exhaust section, and a space portion formed between the ink storage section and the exhaust section, an ink-jet head, and two flexible flat cables (FPC) which are drawn in mutually opposite directions from the ink-jet head. One FPC is wired by passing along a side of the ink supplying member, opposite to the exhaust section, and the other FPC is wired by passing through the space portion. Since the FPC is wired avoiding the ink supplying member and the exhaust section, it is possible to eliminate adhering of ink to the FPC, and to eliminate a waste of FPC wiring. Moreover, it is possible to reduce a cost, and to uniformize electrical characteristics of the two flexible flat cables.

11 Claims, 9 Drawing Sheets

INK-JET RECORDING APPARATUS

CROSS REFERENCE TO RELATED APPLICATION

The present application claims priority from Japanese Patent Application No. 2006-133688 filed on May 12, 2006, the disclosure of which is incorporated herein by reference in its entirety.

BACKGROUND OF THE INVENTION

1. Field of the Invention

The present invention relates to an ink-jet recording apparatus which carries out recording by jetting an ink, and particularly to an ink-jet recording apparatus in which, an ink-jet head and an circuit board are connected by a flexible flat cable (FFC, flexible print circuit (FPC)), and an ink supplying member is arranged between the ink-jet head and the circuit board.

2. Description of the Related Art

As an ink-jet head applicable to an ink-jet recording apparatus, an ink-jet head which includes a cavity portion having nozzles formed in a surface (front surface) facing a recording medium, and ink channels formed therein, an actuator which selectively applies a jetting pressure to the ink inside the cavity portion, and a FFC which transmits a driving signal which is to be supplied to this actuator has hitherto been known. As it has been disclosed in FIG. 2 and FIG. 3 of US2005/140741A1 (corresponds to Japanese Patent Application Laid-open No. 2005-178306), such ink-jet head is fixed to a head holder, and mounted on the ink-jet recording apparatus.

In recent years, for dealing with a high-speed printing and/or high-density printing, there has been a tendency of increasing the number of nozzles (or nozzle rows) of the ink-jet head. In an ink-jet recording apparatus described in US2005/140741A1, for increasing the number of nozzle rows, two recording heads are arranged in parallel in a front surface of a head holder. Two FFCs (FPCS) are drawn from each recording head, in mutually opposite directions, and the FFCs are connected to a circuit board at a position at which the FFCs face mutually, the circuit board being fixed to a rear-surface side of the head holder.

An ink tank which supplies an ink from an ink cartridge to the recording head is mounted between the recording head and the printed circuit substrate in the head holder of the ink-jet recording apparatus described in US2005/140741A1. The ink tank is formed to be substantially rectangular parallelepiped shaped (cuboid). The two FFCs which are drawn in the mutually opposite directions from each recording head pass along a side of the ink tank from a front-surface side of the head holder, and reach the printed circuit board on the rear-surface side of the head holder. The two FFCs are wired to be bilaterally symmetrical in a side view.

In FIG. 4 of Japanese Patent Application Laid-open No. 2005-125636, a damper unit which also functions as an ink tank for storing an ink, and an exhaust valve means (unit) which removes air bubbles from the damper unit are connected integrally. Since the exhaust valve means removes the air bubbles included in the ink of the damper unit, it is possible to prevent from occurring a jetting defect due to mixing of the air bubbles in the ink-jet head.

SUMMARY OF THE INVENTION

In an ink-jet recording apparatus described in US2005/140741A1, instead of the ink tank, when the damper unit and the exhaust valve unit described in the Japanese Patent Application Laid-open No. 2005-125636 are mounted on the head holder, it is not possible to draw around the two FFCs to be bilaterally symmetrical in a side view. This is because, the exhaust valve unit is connected to the side surface of the damper unit described in Japanese Patent Application Laid-open No. 2005-125636.

Concretely, in Japanese Patent Application Laid-open No. 2005-125636, one recording head is arranged on a front surface of the damper unit, and further, the exhaust valve means is connected to the damper unit such that the exhaust valve unit is projected sideward. Therefore, as in a case described above, when two FFCs to be connected to two recording heads are wired to a rear-surface side of the head holder, the FFCs are drawn to a side of the damper unit on which the exhaust valve unit is arranged. One FFC is longer than the other FFC which is drawn to an opposite side of the side of the damper unit on which the exhaust valve unit is arranged. This is because one FFC runs along the side of the exhaust valve means opposite to the damper unit. Therefore, there are problems that a cost of the FFCs becomes high, and that electrical characteristics of one FFC do not match with those of the other FFC.

Moreover, in this case, since the exhaust valve unit is covered by the FFC, there is a possibility of occurrence of an electrical short circuit when an ink, which is discharged at the same time when air bubbles are discharged from an outer opening end provided to the exhaust valve unit, is adhered to the FFC and flows to a terminal portion. Moreover, there is a problem that it becomes difficult to control a discharge of the air bubbles by opening and closing the exhaust section.

The present invention is made in view of the abovementioned circumstances. An object of the present invention is to realize a reduction of cost and uniformization of electrical characteristics of the FFCs by preventing from adhering to the FFC the ink discharged along with the discharge of the air bubbles from an exhaust section, and/or eliminating a waste of wiring of the FFCs, in an ink-jet recording apparatus which includes a head holder in which an ink-jet head and an ink supplying member having a damper unit and an exhaust valve unit, and two FFCs which are wired from a front-surface side of the head holder to an circuit board of a rear-surface side.

According to a first aspect of the present invention there is provided an ink-jet recording apparatus which jets droplets of an ink onto a recording medium, including an ink-jet head which selectively jets the droplets of the ink, including a cavity unit in which a cavity and a plurality of nozzles which communicate with the cavity are formed, and an actuator which applies a jetting pressure to the ink in the cavity;

a circuit board on which an electric circuit which is electrically connected to the actuator is formed, the circuit board being arranged on the ink-jet head on a side opposite to the nozzles;

an ink supplying unit which is arranged between the ink-jet head and the circuit board, the ink supplying unit including an ink storage section which stores the ink to be supplied to the ink-jet head, an exhaust section which is connected to the ink storage section to remove air bubbles generated in the ink stored in the ink storage section, and a space formed in the ink supplying unit penetrating therethrough from a side of the ink-jet head of the ink supplying member up to the circuit board, the space being formed between the ink storage section and the exhaust section; and two flexible flat cables which connect the actuator and the circuit board, the flexible flat cables including a first flexible flat cable which is wired to pass along a side, of the ink storage section, opposite to the exhaust section, and a second flexible flat cable which is drawn from the actuator to the other side, of the ink storage section, opposite to the first flexible flat cable to be wired to pass through the space.

According to the first aspect of the present invention, from among the two FFCs which are arranged in parallel, to be drawn in mutually opposite directions, one FFC passes through a space portion formed between the exhaust section and the ink storage section of the ink supplying member, and the other FFC passes along a side of the ink storage chamber (section) on the opposite side of the space portion, and each of the FFCs is connected to the circuit board. Therefore, it is possible to match a length of the two FFCs. Accordingly, it is possible to prevent unevenness in electrical characteristics of the two FFCs, and to reduce a cost of members by decreasing the length of the cables.

The ink-jet recording apparatus of the present invention, may further include a head holder which is substantially box shaped and which holds the ink-jet head, the ink supplying unit, and the circuit board, the ink-jet head and the circuit board being held so as to overlap with each other in a plan view. The exhaust section may have an outer opening which is opened to outside of the ink supplying unit, at a side opposite to the ink storage section with respect to the second flexible flat cable.

In the ink-jet head, since the ink supplying member and the circuit board are held by the head holder, it is possible to fix easily the ink supplying member and the circuit board. Since the outer opening of the exhaust section opens to an outside at a side of the second FFC, opposite to the ink storage chamber, even when the ink is discharged with the air bubbles from the exhaust section, the ink is not adhered to the FFC, and it is possible to avoid a short-circuit accident due to adhering of the ink to the FFC.

The ink-jet recording apparatus of the present invention may further include an exhaust valve which is provided on the exhaust section, and which connects and disconnects an outside of the ink supplying unit and the ink storage section through the outer opening; and an operating mechanism which is provided outside of the head holder, and which operates the exhaust valve.

According to the ink-jet recording apparatus of the present invention, since the outer opening of the exhaust section opens on the outside of the second FFC, on the opposite side of the ink storage section, it is possible to open and close more easily the exhaust vale which opens and closes with respect to the outside of the outer opening, by an operation of the operating mechanism, and to discharge appropriately to the outside the air bubbles accumulated in the ink storage section. As a result, it is possible to prevent an occurrence of a discharge defect caused due to mixing of the air bubbles of the ink storage section into the ink-jet head.

The ink-jet recording apparatus of the present invention may include further a suction mechanism which is provided outside of the head holder, which is detachable from the outer opening of the exhaust section, and which sucks air bubbles from the ink storage section when the suction unit is in closely contact with the outer opening.

Since the outer opening of the exhaust section is opened on the outer side of the second FFC, on the opposite side of the ink storage chamber (section), it is possible to bring in close contact and detach the suction mechanism with and from the outer opening of the exhaust section, and to discharge assuredly the air bubbles accumulated in the ink storage section.

In the ink-jet recording apparatus of the present invention, the flexible flat cables (the first FFC and the second FFC) may have a belt shape, and the space may be formed as a slit of which cross section corresponds to a cross section of the belt shaped flexible flat cables.

Since the space is formed as a slit of which cross section corresponds to a cross section of the belt shaped FFC, it is possible to provide the space without increasing remarkably a size of the entire ink supplying member.

In the ink-jet recording apparatus of the present invention, the ink supplying member may include a connecting portion connecting the ink storage chamber and the exhaust section, the connecting portion partially overlapping in a plan view with an extending area in which the second flexible flat cable is extended in a longitudinal direction thereof, and which has a width at a position, of the second flexible flat cable, at which the second flexible flat cable is drawn from the actuator; and the second flexible flat cable is formed to be belt shaped, which is shifted at an intermediate portion or at an end portion in a width direction of the second flexible flat cable to avoid the connecting portion.

The intermediate portion, in a longitudinal direction, of the FFC or the end portion of the FFC is formed in advance to be shifted in the direction of width, according to a relationship between a width of the FFC at a position drawn from the actuator and the connecting portion between the exhaust section and the ink storage section in the ink supplying member, it is possible to connect the second FFC which passes through the space portion to the circuit board without being twisted or bent in between the longitudinal direction.

In the ink-jet recording apparatus of the present invention, the flexible flat cables may include a plurality of cables connected in a longitudinal direction of the cables.

Since the first FFC and/or the second FFC includes the cables connected in the longitudinal direction, for example, it is possible to divide the cables as cables to be connected to the actuator, and cables to be connected to the circuit board. In this case, at the time of handling the ink-jet head singly, it is possible to carry out work operation without the cables to be connected to the circuit board not being connected. In other words, since it is possible to shorten a length of the FFC at the time of handling the ink-jet head singly, it is possible to reduce a possibility of detachment of the FFC, and the actuator, and a damage of the FFC.

In the ink-jet recording apparatus of the present invention, each of the flexible flat cables may have a flat portion which is joined to the actuator, and a flexible portion which is continuous to the flat portion and on which a chip circuit which drives the actuator is mounted. The head holder may have a bottom plate in which the ink-jet head is fixed to one surface thereof, and in which slit holes each for drawing the flexible portion of one of the flexible flat cables toward a rear-surface side of the bottom plate are formed for the flexible portions respectively; and a plurality of heat sinks which is disposed on a side of the other surface of the base plate, and which makes a contact with the chip circuit disposed on the flexible portion, the heat sinks corresponding to the flexible flat cables and guiding the flexible portion of the flexible flat cables to the circuit board. A heat sink, among the heat sinks, corresponding to the second flexible flat cable may be provided along the space.

Since two heat sinks are provided on the rear-surface side of the base plate of the head holder, one heat sink corresponding to each flexible portion of the flat and flexible portion drawn in the mutually opposite directions from the actuator, and raised on the rear-surface side of the base plate of the head holder, it is possible to make the chip circuit of the flexible portion release heat efficiently, due to each heat sink. Moreover, since each FFC is guided up to the circuit board, along the heat sink, it is possible improve a wiring strength of the FFC.

In the ink-jet recording apparatus of the present invention, the actuator may have a first actuator and a second actuator, and one end of the first FFC may be connected to the first actuator, and one end of the second FFC may be connected to the second actuator. In this case, since the ink-jet recording apparatus has a plurality of actuators, it is possible to improve a nozzle density.

In the ink-jet recording apparatus of the present invention, the first flexible flat cable and the second flexible flat cable may have mutually different shapes. In this case, since the first FFC and the second FFC have mutually different shapes, it is possible to adjust according to a wiring route of each FFC.

In the ink-jet recording apparatus of the present invention, the first flexible flat cable and the second flexible flat cable may have shifted portions shifted toward one side in a width direction of the flexible flat cables respectively, and the shifted portion of the second flexible flat cable may be shifted to an extent greater than that of the shifted portion of the first flexible flat cable. In this case, since the shifted portion which is substantially shifted is formed on the second FFC which is wired through the space portion, it is possible to connect the second FFC which is wired through the space portion to the circuit board without being twisted or bent in between in the longitudinal direction.

DETAILED DESCRIPTION OF THE PREFERRED EMBODIMENTS

Figure 1:
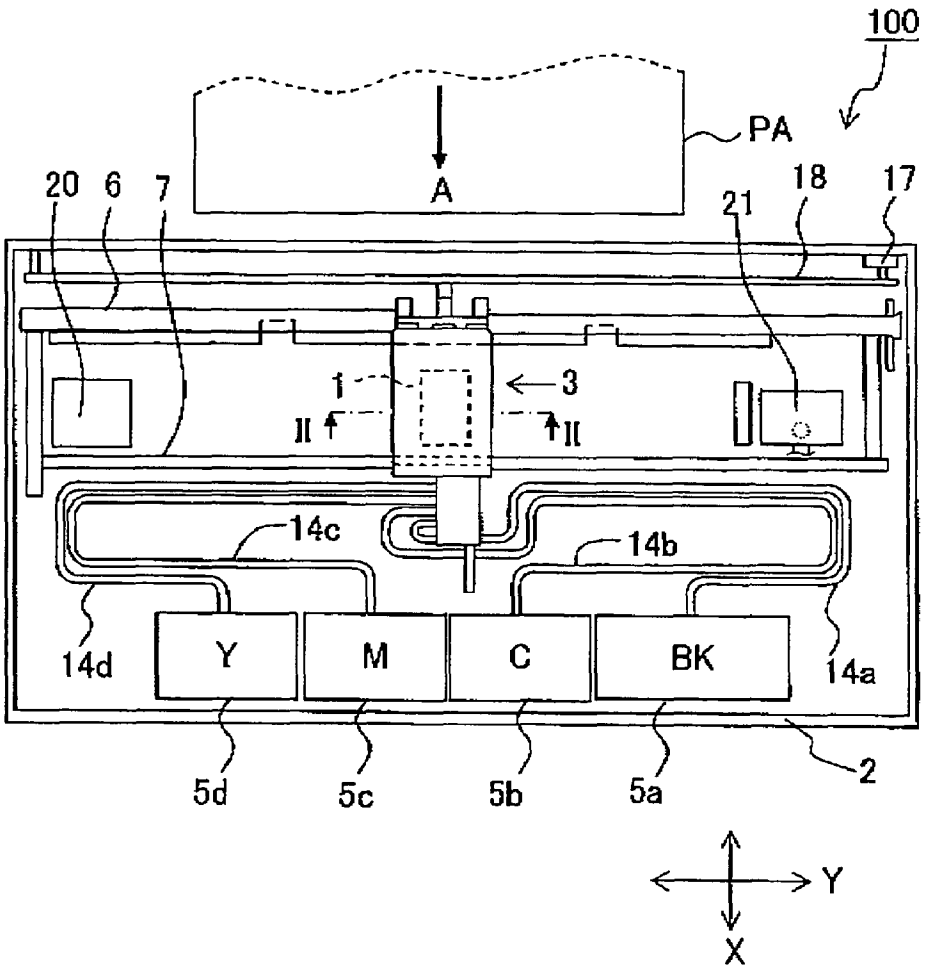
FIG. 1 is a plan view of an ink-jet recording apparatus according to the present invention.

A basic embodiment of the present invention will be described below with reference to the accompanying diagrams. FIG. 1 shows an ink-jet recording apparatus 100 to which the present invention is applied. It is possible to use the ink-jet recording apparatus 100 of this embodiment not only as a printer alone, but also as printer in a multi function device (MFD) which is provided with functions such as a printer function, a copier function, a scanner function, a facsimile function and the like. The ink-jet recording apparatus 100 includes: a main-body frame 2; two guide shafts (a rear guide shaft 6 and a front guide shaft 7) which are provided in parallel along a main scanning direction (Y direction) inside the main-body frame; an ink-jet head 1 which is provided inside the main-body frame 2 and which performs recording by jetting an ink on to a paper PA which is a recording medium; a carriage 3 on which the ink-jet head 1 is mounted and which travels along the main scanning direction (Y direction); ink supply sources 5*a*, 5*b*, 5*c*, and 5*d* (5*a* to 5*d*) which are arranged inside the main-body frame; and an ink supply tube 14 which connects the ink supply sources 5*a* to 5*d* and the ink-jet head 1.

The carriage 3 is slidably mounted on the rear guide shaft 6 and the front guide shaft 7. The carriage 3 is capable of reciprocating in the main scanning direction (Y direction), by a carriage driving motor 17 which is arranged at a rear-right side in the main-body frame 2, and a timing belt 18 which is an endless belt. In the main-body frame 2, the ink supply sources (ink tanks) 5*a* to 5*d* are arranged, and the ink supply sources 5*a* to 5*d* supply an ink to the ink-jet head 1 via the ink supply tubes 14. The ink-jet recording apparatus 100 of this embodiment is provided with the ink supply sources 5*a* to 5*d* which supply inks of four colors (black, yellow, magenta, and cyan) (refer to FIG. 1).

The paper PA is transported horizontally along a lower-surface side of the ink-jet head 1 (direction A in FIG. 1), along a secondary scanning direction (X direction) which is orthogonal to the scanning direction (Y direction). The ink is jetted in a downward direction to perform printing, on to the paper PA from nozzles 4 (refer to FIG. 5) of the ink-jet head 1 which moves in the main scanning direction (Y direction).

An ink receiving section 20 is arranged at one side (left side of FIG. 1 in this embodiment) of an inner portion of the main-body frame (flushing position), on a farther outer side than the paper PA which is transported, and a maintenance unit 21 is arranged at the other side of the inner portion of the main-body frame (head stand-by position). Accordingly, the ink-jet head 1 jets the ink periodically, at a flushing position, during a recording operation in order to prevent the blocking of the nozzles. This ink is received at the ink receiving section 20. Moreover, a cleaning of the ink-jet head 1 such as wiping a nozzle surface of the ink-jet head 1 by the maintenance unit 21, and a recovery process for sucking the ink and the air bubble for each color in coordination with an exhaust section 25 which will be described later are carried out at the head stand-by position.

Figure 2:
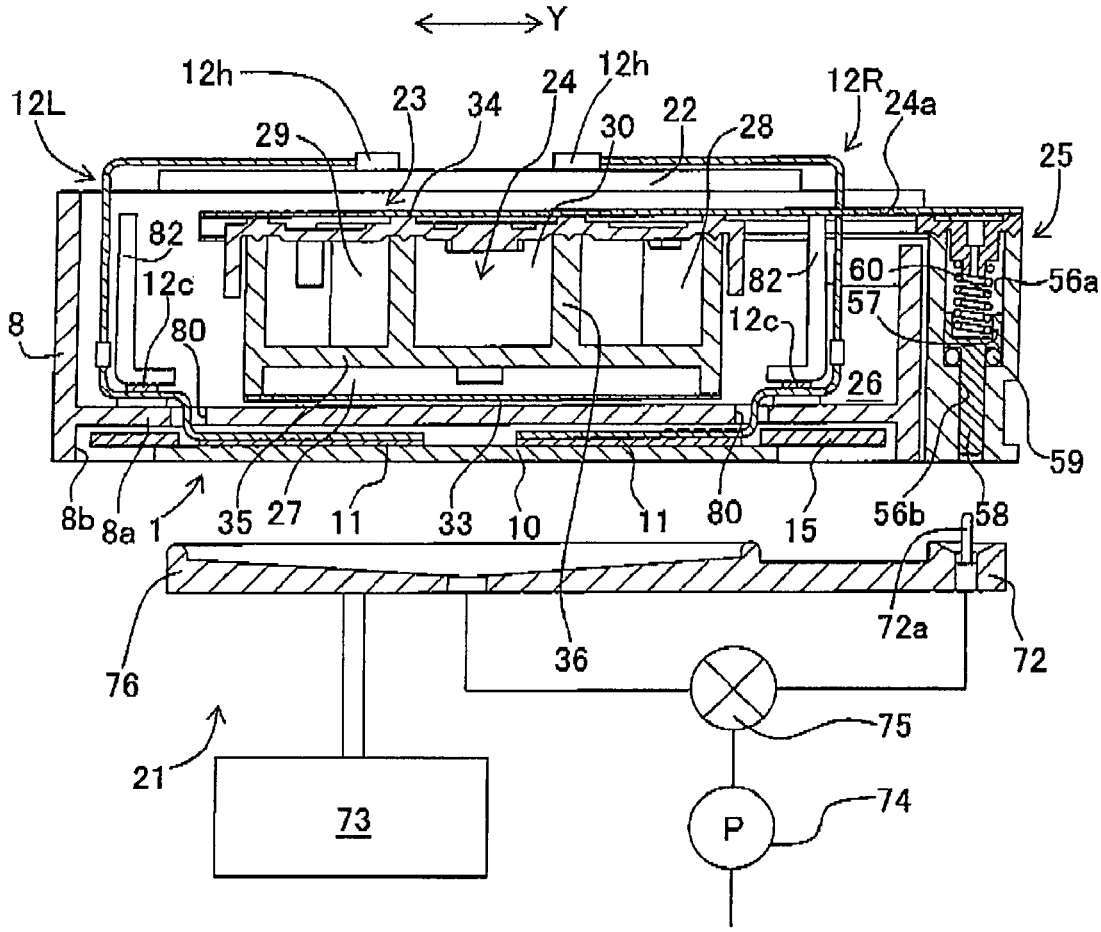
FIG. 2 is a cross-sectional view taken along a line II-II, showing a relationship with a maintenance unit.

A head holder 8 is mounted on the carriage 3. As shown in FIG. 2, the head holder 8 has a substantially box shape opened at an upper surface, and a recess 5*b* is formed to be opening downward, in a lower-surface of a bottom plate 8*a* of the head holder 8. The ink-jet head 1 having a substantially flat shape is accommodated in the recess 5*b*. At this time, a surface of the ink-jet head 1 in which the nozzles 4 open is exposed in a downward direction from the head holder 8. The ink-jet head 1 is fixed by an adhesive to the bottom plate 5*a* with a predetermined gap such that the ink-jet head 1 is almost parallel to the lower-surface of the bottom plate 5*a* which is a ceiling surface of the recess 5*b*. In the description, a surface of the ink-jet head 1 in which the nozzles open is called as a front surface or a lower surface, and another surface opposite to the front surface (lower surface) is called as a rear surface or an upper surface.

An circuit board 22 having a stiffness is fixed to a rear-surface side of the head holder 8, bridging two opposite sides of the opening in the upper surface of the head holder 8. An electric circuit is formed on this circuit board 22, and is arranged at a position on the rear-surface side of the head holder 8, overlapping the ink-jet head 1, in a plan view. The circuit board 22 is connected to the ink-jet head 1 via FFCs (FPCs) 12L and 12R which will be described later, and is also connected to a control substrate on a main-body side which is arranged inside the main-body frame 2, via a FFC which is not shown in the diagram. An ink supplying member (ink supplying unit) 23 is mounted on an upper-surface side of the bottom plate 8*a* of the head holder 8, between the ink-jet head 1 and the circuit board 22 (refer to FIG. 2). The ink supplying member 23 temporarily stores the ink supplied via the ink supply tube 14 (14*a* to 14*d*), and supplies to the ink-jet head 1.

The ink-jet head 1 includes a cavity unit 10 in which a plurality of nozzles 4 and an ink channel are formed; a piezoelectric actuator 11 which applies a pressure to the ink in the cavity unit 10 to selectively jet the ink from the nozzles 4; and the FFC 12L (first FFC) and the FFC 12R (second FFC) each transmitting a driving signal to the piezoelectric actuator 11: and these components are arranged in stacked form.

Figure 3:
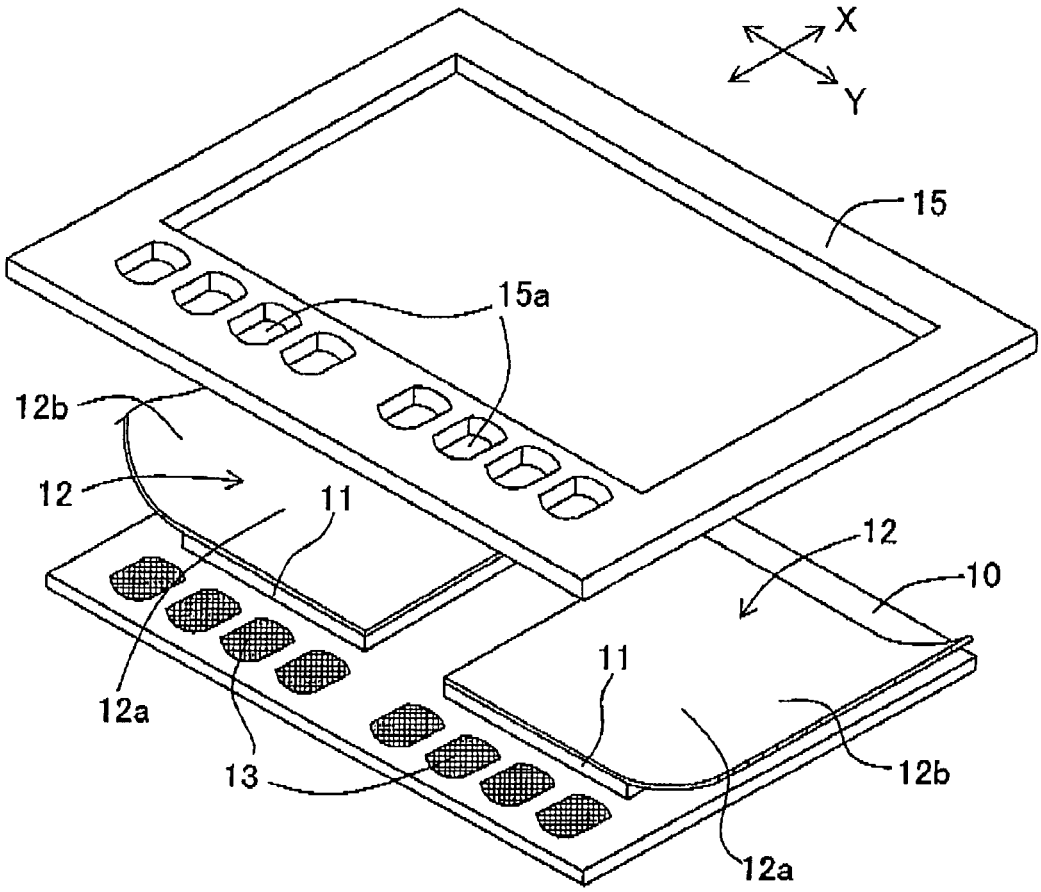
FIG. 3 is a perspective view of an ink-jet head.

As shown in FIG. 3, in this embodiment, two piezoelectric actuators 11 are stacked side by side in the Y direction on a rear surface of one cavity unit 10. The FFCs 12L and 12R are stacked on the piezoelectric actuators 11, respectively, and the two FFCs are drawn in mutually opposite directions along the Y direction. Moreover, a reinforcing frame 15 is stacked on the rear surface of the cavity unit 10 to surround the two piezoelectric actuators 11 integrally.

Figure 4:
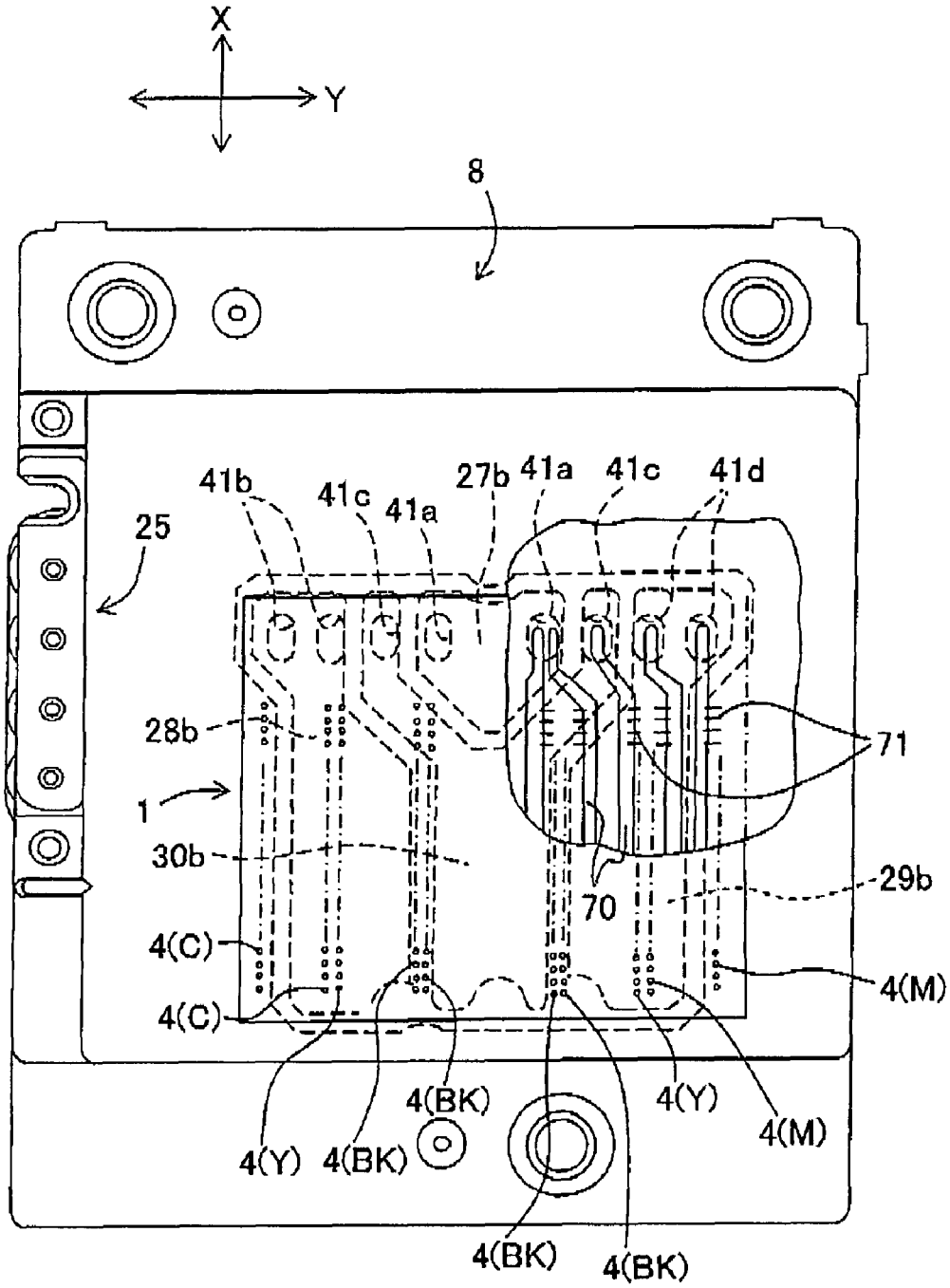
FIG. 4 is a bottom view of the ink-jet head.

As shown in FIG. 4, 10 nozzle rows arranged at a predetermined interval in the Y direction are formed in the cavity unit 10 of the ink-jet head 1 (refer to FIG. 3). Each of the nozzle rows has a plurality of nozzles 4 aligned in the X direction (secondary scanning direction) of the carriage 3. Four nozzle rows among the ten nozzle rows correspond to a black ink (Bk), and two nozzle rows, among the ten nozzle rows, each correspond to a magenta ink (M), a cyan ink (C), and a yellow ink (Y). In this embodiment, ink colors are assigned to the ten nozzle rows in an order of cyan, cyan, yellow, black, black, black, black, yellow, magenta, and magenta, from a left side in FIG. 4.

Similar to a disclosure in Japanese Patent Application Nos. 2002-67312 and 2001-219560, as shown in FIG. 3, eight ink intake ports 13 which are opening on one end side in the X direction on an upper surface of the cavity unit 10 are formed. The ink which is supplied individually to each of the ink intake ports 13 from ink outflow ports 41*a* to 41*d* of an ink storage section 24 is distributed to a large number of pressure chambers 71 via each of the manifold chambers 70. The cavity unit 10 selectively jets the ink from each of the nozzles 4 communicating with one of pressure chambers 71 (refer to FIG. 4) by driving of the piezoelectric actuator 11 corresponding to the one of the pressure chambers 71.

The FFCs 12L and 12R are belt shaped. At one end thereof, a flat portion 12*a* which is joined in a stacked form on an upper surface of the piezoelectric actuator 11 is formed, and at the other end, a flexible portion 12*b* which is in continuity with the flat portion 12*a* is formed. A chip circuit 12*c* which drives the piezoelectric actuator 11 is mounted on the flexible portion 12*b* (refer to FIG. 2, FIG. 5, and FIG. 6). Each of the FFCs 12L and 12R of this embodiment has a first cable 121 which is to be connected to the piezoelectric actuator 11, and a second cable 122 which is to be connected to the circuit board 22, and the first cable 121 and the second cable 122 are connected in a longitudinal direction.

Figures 5A, 5B:
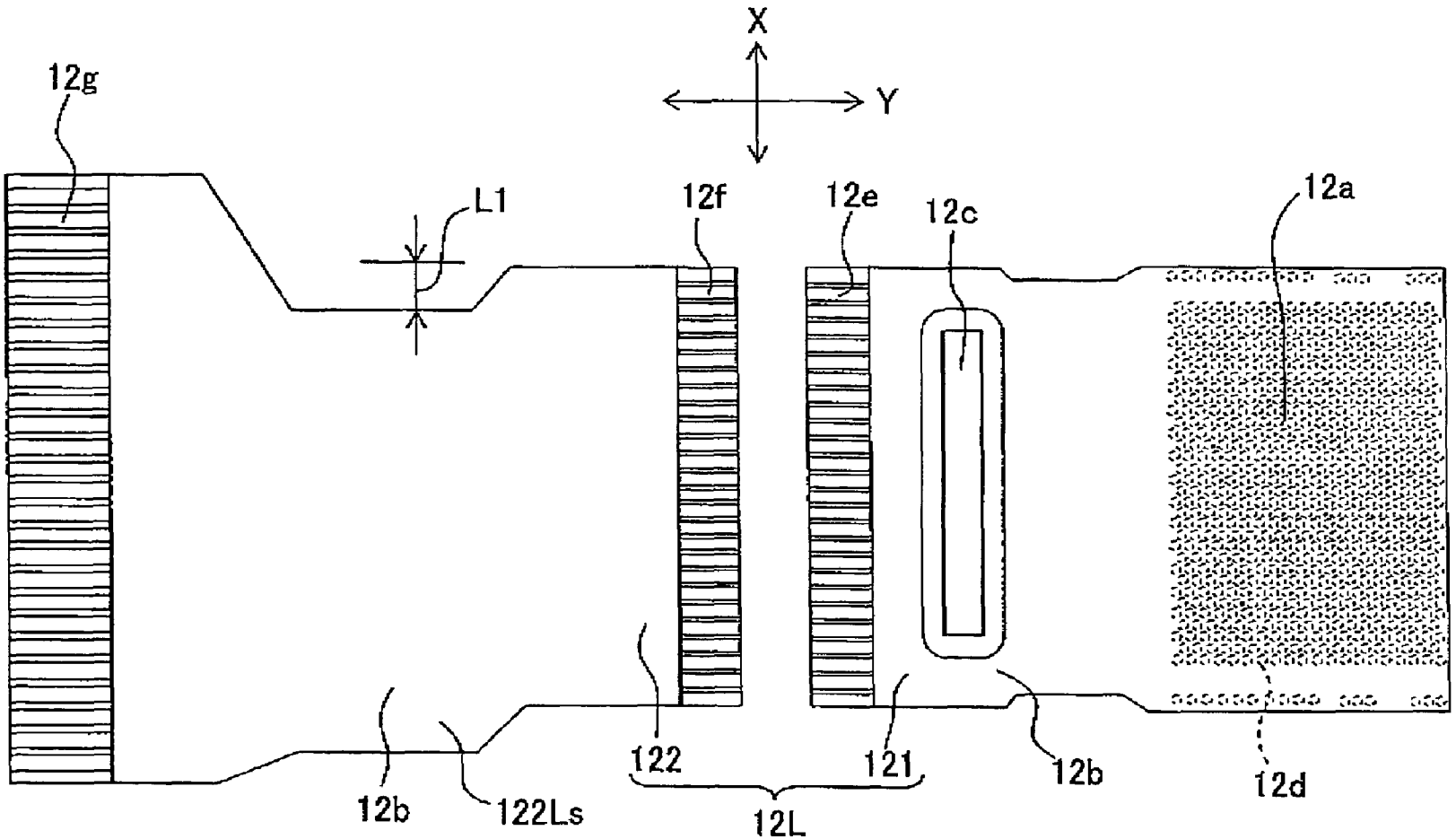
FIGS. 5A and 5B are projected diagrams of a FFC which is drawn toward an opposite side of an exhaust section.
Figures 6A, 6B:
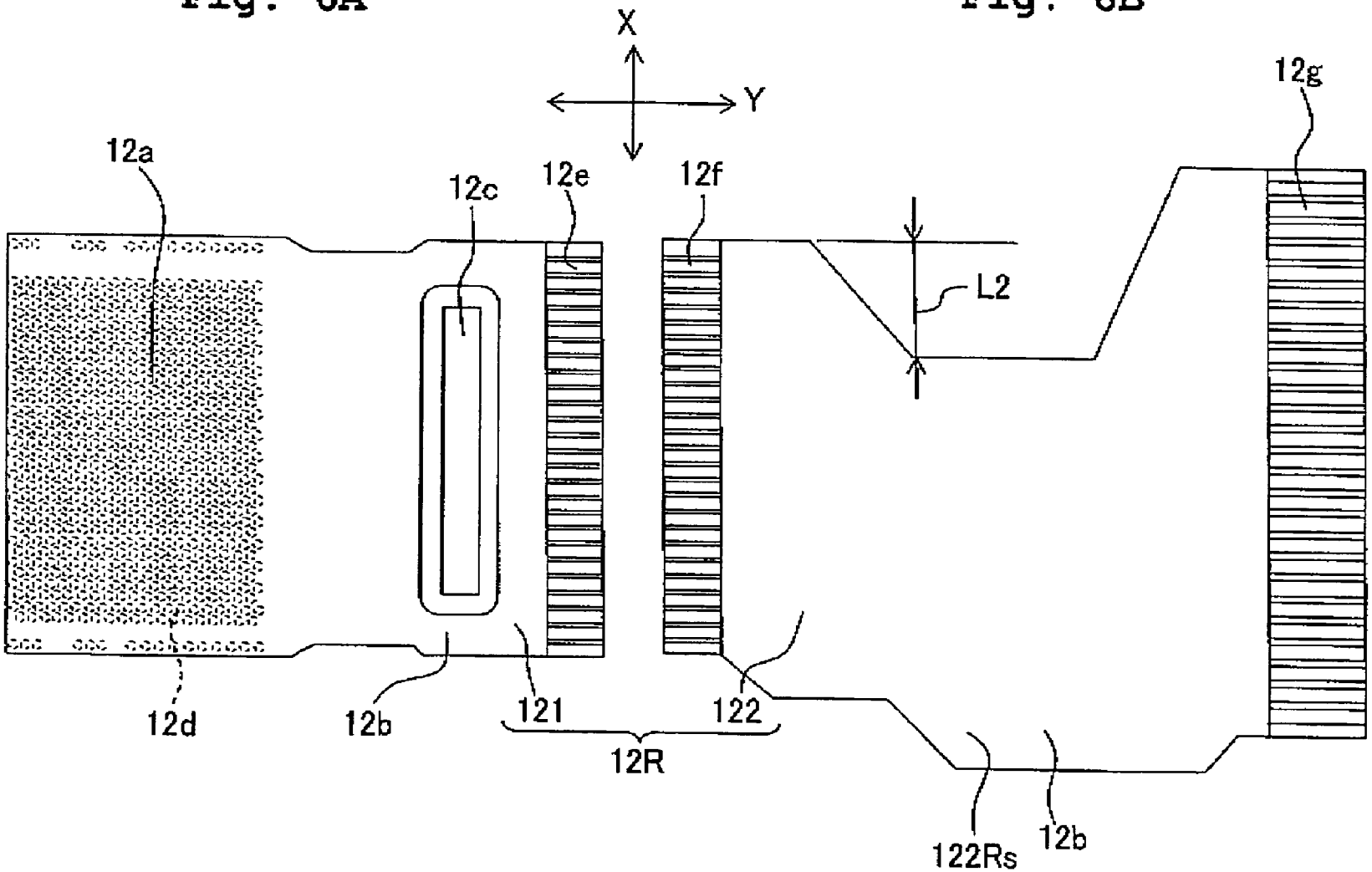
FIGS. 6A and 6B are projected diagrams of a FFC which is drawn toward a side of the exhaust section.

As shown in FIGS. 5 and 6, the first cable 121 has a flat portion 12*a*, and a plurality of terminal electrodes 12*d* formed on a surface of the flat portion 12*a* facing the piezoelectric actuator 11, for connecting electrically to the piezoelectric actuator 11. These terminal electrodes 12*d* are connected to a common electrode and an operating portion of the piezoelectric actuator 11 corresponding to the pressure chambers 71. The flexible portion 12*b* of the first cable 121 is shorter than the flexible portion 12*b* of the second cable 122. The chip circuit 12*c* is mounted on the flexible portion 12*b* of the first cable 121, and a connecting terminal 12*e* for connecting to the second cable 122 is provided at an end portion of the flexible portion 12*b* of the first cable 121, on an opposite side of the flat portion 12*a*.

The second cable 122 is flexible entirely, and includes a flexible portion 12*b* which is longer than the flexible portion 12*b* of the first cable 121. A connecting terminal 12*f* for connecting to the first cable 121 is formed at one end of the flexible portion 12*b* of the second cable 122, and a connecting terminal 12*g* for connecting to a connector 12*h* on the circuit board 22 is formed at the other end of the flexible portion 12*b* of the second cable 122. A shape of the FFC 12 will be described later.

As shown in FIG. 2, two slits 80 through which the flexible portion 12*b* of the FFCs 12L and 12R are pierced from a front-surface side to a rear-surface side are formed in the bottom plate 8*a* of the head holder 8. Each of the slits 80 is long in the X direction, and the two slits 80 are formed at an interval in the Y direction. A heat sink 82 is fixed on an upper-surface side of the bottom plate 8*a* of the head holder 8 adjacent to the two slits 80. The heat sink 82 is a metallic member having a favorable thermal conductivity, which is formed by bending such that bottom and side surfaces of the heat sink form a shape of an English alphabet L in a side view, the bottom surface being parallel to the bottom plate 8*a* of the head holder 8, and the side surface being parallel to a side wall of the head holder 8 facing the Y direction.

The flexible portions 12*b* of the FFCs 12L and 12R are passed between the bottom plate 8*a* and the bottom surface of the heat sink 82, and the chip circuit 12*c* thermally contacts with the bottom surface of the heat sink 82 upon being pushed by a rubber elastic body 81. Accordingly, heat generated in the chip circuit 12*c* is released by the heat sink 82. Moreover, as shown in FIG. 2, the connecting terminal 12*e* of the first cable 121 and the connecting terminal 12*f* of the second cable 122 are connected at a position toward a lower-end portion of a side surface of the heat sink 82. The second cable 122 is guided to the circuit board 22, which is positioned at the rear-surface side of the head holder 8, along the side surface of the heat sink 82.

The reinforcing frame 15 is a flat member which reinforces the cavity unit 10. The reinforcing frame 15 is formed of a material (for example, a metallic plate of stainless steel) having a stiffness superior to a stiffness of the cavity plate 10, and has an outer shape slightly larger than the cavity unit 10. By stacking the reinforcing frame 15 to surround the piezoelectric actuator 11, along the rear surface of the cavity unit 10, a deformation and a distortion of the cavity unit 10 which is thin and flat shaped are prevented. Eight connecting holes 15*a* for connecting the ink intake port 13 of the cavity unit 10, and the ink outflow ports 41*a* to 41*d* of the ink storage section 24 which will be described later are arranged side by side at one end portion of the reinforcing frame 15 in the X direction.

Next, the ink supplying member 23 will be described below. In the ink supplying member 23, the ink storage section (ink tank) 24 and the exhaust section (air exhaust unit) 25 are connected integrally. An inside of the ink storage section 24 is divided into a plurality of ink chambers 27 to 30, and the ink storage section 24 stores the inks in these ink chambers according to the color of the ink. The exhaust section 25 removes bubbles accumulated in the ink storage section 24. The exhaust section 25 is connected to the ink storage section 24 by a connecting portion 24*a* which will be described later.

The ink outflow ports 41*a* to 41*d* of each of the ink chambers 27 to 30 are provided at one side, in the X direction, of the bottom surface of the ink storage section 24. The ink outflow ports 41*a* to 41*d* are connected to the ink intake port 13 of the ink-jet head 1 via an elastic sealing member (not shown in the diagram) and the connecting holes 15*a* of the reinforcing frame 15, on an inner side of an opening (not shown in the diagram) which is formed through the bottom plate 8*a*. Accordingly, the ink of each color is supplied independently from the ink chambers 27 to 30 to each of the ink intake ports 13 of the ink-jet head 1.

Figure 7:
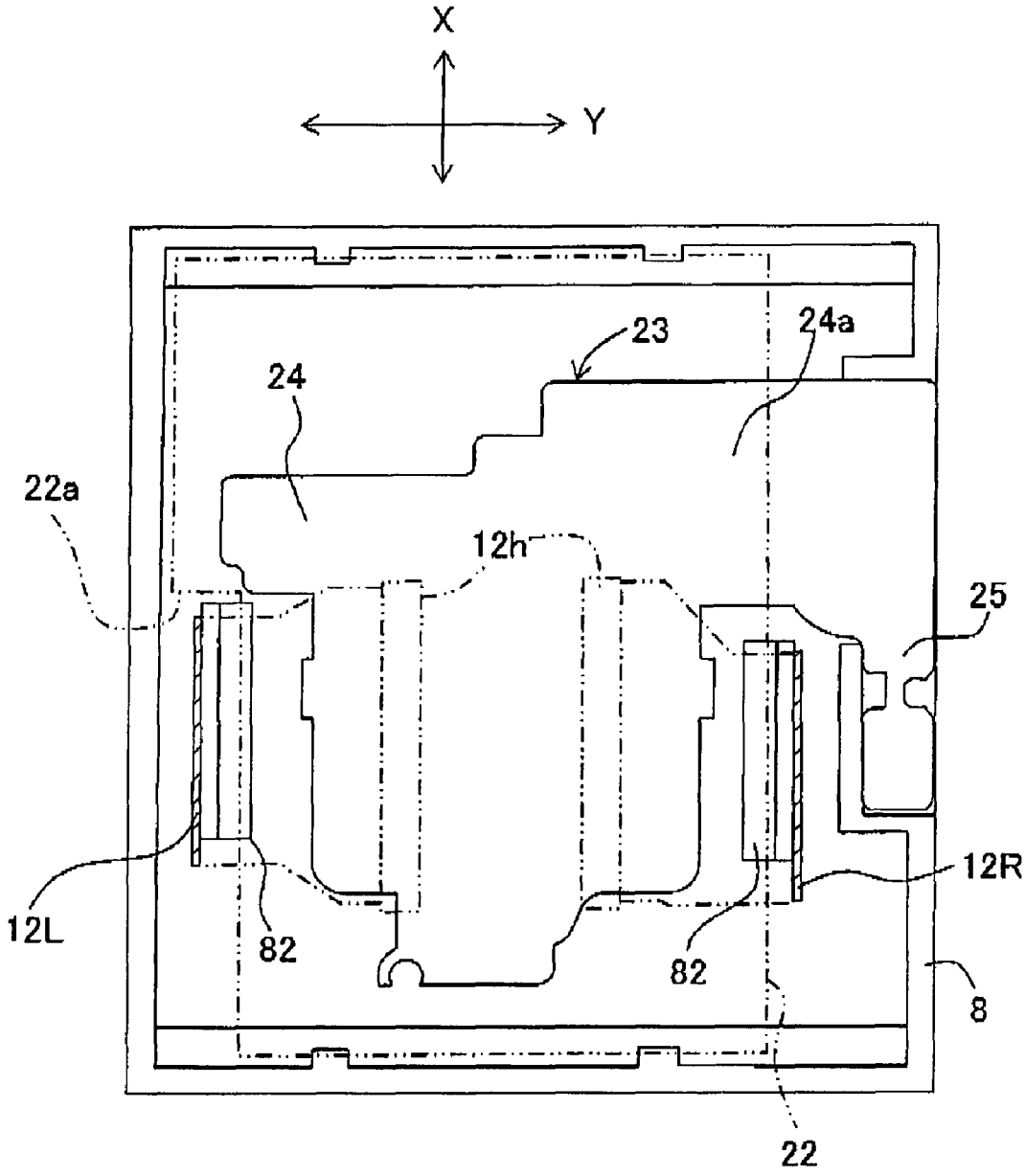
FIG. 7 is a plan view showing a positional relationship of an ink supplying member and the FFC.

The connecting portion 24*a* of the ink storage section 24 and the exhaust section 25 is arranged on a side of the ink storage section 24 (one side in X direction) where the ink outflow ports 41*a* to 41*d* are provided. The connecting portion 24*a* is extended in the Y direction from the ink storage section 24. A space 26 in the form of a slit corresponding to a cross-section of a belt shape of the FFC 12R is formed in an area of the ink supplying member 23, between the ink storage section 24 and the exhaust section 25. The space 26 is pierced from a front surface side to a rear-surface side of the ink supplying member 23, and is formed as a notch extending from the other side in the X direction, in a plan view. In detail, as shown in FIG. 7, at a position where the FFC 12R is drawn from the piezoelectric actuator 11, the FFC 12R has a portion which overlaps partly in a plan view with the connecting portion 24*a*. In other words, at the position of drawing from the piezoelectric actuator 11, a part in the X direction (width direction) of the FFC 12R overlaps with a part in the X direction (width direction) of the connecting portion 24*a*. The space 26 may not be formed only in the form of a notch in a plan view, but may be formed in the form of a long hole in a plan view according to the requirement.

The ink-jet head 1 has the two FFCs 12L and 12R. The FFC 12R, drawn toward a side where the exhaust section 25 is provided, rises up upon passing through the space 26 formed in the area of the ink supplying member 26 between the exhaust section 25 and the ink storage section 24, and the FFC 12L rises up upon passing along a side of the ink storage section 24 opposite to the exhaust section 25. The FFCs 12L and 12R are connected at a position facing the circuit board 22 which is arranged on the rear-surface side. Accordingly, since a distance of drawing around becomes short, as compared to a case when passed along an outer side of the exhaust section 25, it is possible to make a length of the FFC 12R same as a length of the FFC 12L.

Both of the two FFCs 12L and 12R are extended to connect from a connecting position with the piezoelectric actuator 11 up to a connecting position with the circuit board 22. For avoiding a contact with the circuit board 22 and the connecting portion 24*a* of the ink supplying member 22, the FFCs 12L and 12R are formed to be belt shaped having an inclined portion (a shifted portion) appropriately, in the width direction.

In this embodiment, in the FFC 12L (in particular, the second cable 122) passing along the side of the ink supplying member 23, opposite to the exhaust section 25 (left side in FIG. 2), a shifted portion 122Ls which is inclined (shifted) by only L1 is formed in the width direction (X direction), with respect to the flat portion 12*a* (with respect to a drawing position from the piezoelectric actuator 11). As shown in FIG. 7, the shifted portion 122Ls of the FFC 12L is formed at a position passing through a notch 22*a* on a left side portion of the circuit board 22 for avoiding an interference with a side edge in the width direction of the FFC 12L and an outer edge of the notch 22*a* facing the side edge of the FFC 12L.

On the other hand, in the FFC 12 (in particular, the second cable 122) drawn on a side of the ink supplying member 23, toward the exhaust section 25 (right side in FIG. 2), and wired through the space 26, as shown in FIG. 6, a shifted portion 122Rs which is shifted by only L2 which is greater than L1 is formed in the width direction (X direction), with respect to the flat portion 12*a* (with respect to a drawing position from the piezoelectric actuator 11). The shifted portion 122Rs is formed for avoiding an interference with a side edge in the width direction of the FFC 12R and the connecting portion 24*a* of the ink supplying member 22.

Next, a detailed structure of the ink supplying member 23 which is applicable to this embodiment will be described below by with reference to FIGS. 8A, 8B, and 9. However, a structure of an inside of the ink supplying member 23 described below is an example, and it is not intended to restrict to this structure.

The ink supplying member 23 has an upper case 31, a lower case 32, and two flexible films 33 and 34. As it will be described later, the ink storage section 24 and the exhaust section 25 are formed by the upper case 31, the lower case 32, and two flexible films 33 and 34. The flexible films 33 and 34 are made of a synthetic resin, and are impermeable with respect to air and liquid. The ink chambers 27 to 30 according to each color are provided to the ink storage section 24, and each of the ink chambers 27 to 30 is partitioned by a main partition wall 35 and secondary (sub) partition walls 36 and 37.

Figure 8A:
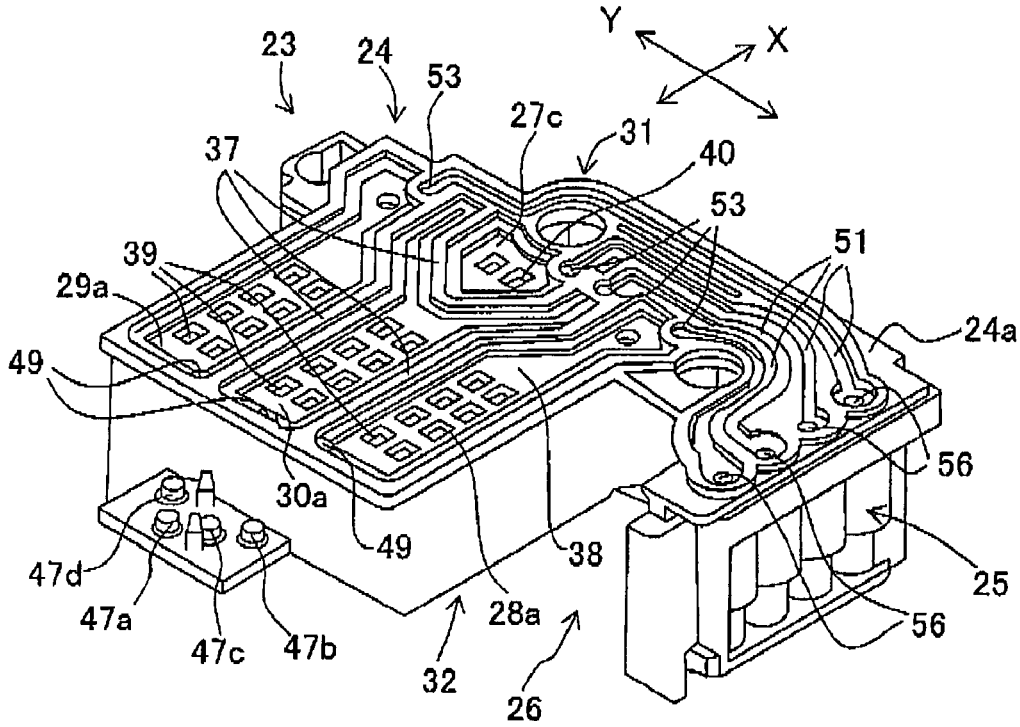
FIG. 8A is a perspective view when the ink supplying member is viewed from a top.
Figure 9:
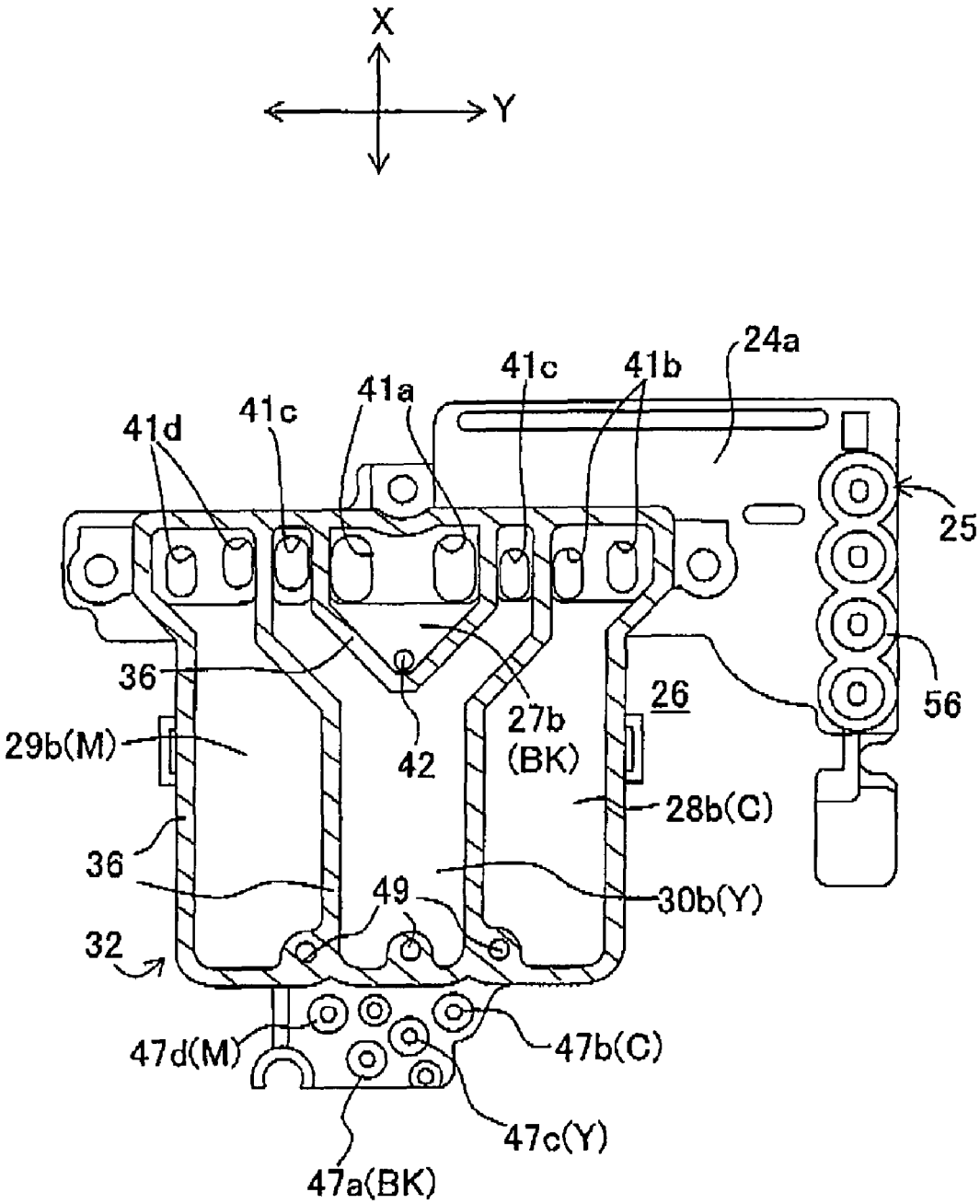
FIG. 9 is a plan view of a lower case of the ink supplying member.

The lower case 32 has an opening (aperture) portion which is formed so as to open a substantial portion of a lower surface of the lower case 32, the main partition wall 35 which is parallel to the opening portion, and formed integrally to the opening portion with a predetermined interval, and the secondary partition wall 36 which is formed integrally to the main partition wall 35 to rise from an upper surface of the main partition wall 35 (refer to FIG. 2 and FIG. 9). The upper case 31 includes the secondary partition wall 37 which is formed at a position corresponding to a position at which the secondary partition wall 36 of the lower case 32 is extended upward (refer to FIG. 8A).

The flexible film 33 is adhered to cover the opening portion of the lower case 32 on a lower surface of the ink storage section 24, and the flexible film 34 is adhered to cover the exhaust section 25 and the ink storage section 24 of the upper case 31, spreading over the exhaust section 25 and the ink storage section 24.

The ink chamber 27 for the black ink (Bk) includes a first chamber 27*a* which is formed between the flexible film 33 and a lower surface of the main partition wall 35 in the lower case 32, a second chamber 27*b* which is partitioned by the secondary partition wall 36 on an upper surface of the main partition wall 35 of the lower case 32, and a third chamber 27*c* which is demarcated by the secondary partition wall 37 in the upper case 31. An upper surface of the third chamber 27*c* is covered by the flexible film 34.

The ink chamber 28 for the cyan ink (C), the ink chamber 29 for the magenta ink (M), and the ink chamber 30 for the yellow ink (Y) include first chambers 28*a*, 29*a*, and 30*a* partitioned by the secondary partition wall 37 in the upper case 31 respectively, and second chambers 28*b*, 29*b*, and 30*b* partitioned by the secondary partition wall 36 on the upper surface of the main partition wall 35 in the lower case respectively. An upper surface of the first chambers 28*a*, 29*a*, and 30*a* is covered by the flexible film 34.

Passage holes 39 which make communicate the first chambers 28*a*, 29*a*, and 30*a* for the color inks (cyan, magenta, and yellow) and the second chambers 28*b*, 29*b*, and 30*b*, and an air hole 40 which makes communicate the second chamber 27*b* for the black ink and the third chamber 27*c*, are made in a bottom wall 38 of the upper case 31.

Figure 8B:
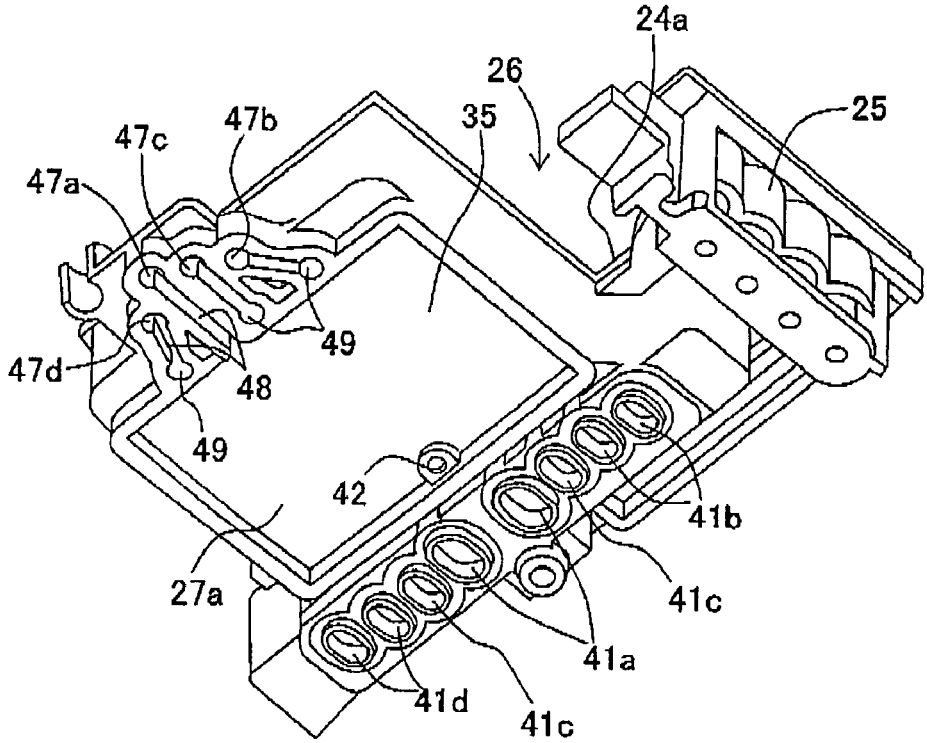
FIG. 8B is a perspective view when the ink supplying member is viewed from a bottom.

As shown in FIG. 8B and FIG. 9, the ink outflow ports 41*a* to 41*d* which make the ink flow out to the ink-jet head 1, are positioned side by side on a lower surface of the second chambers 27*b* to 30*b* for each color, and are opened in a downward direction, at a position extended in a downward direction farther than the flexible film 33.

As shown in FIG. 8B and FIG. 9, ink supply tubes 14*a* to 14*d* from the ink supply sources (ink tanks) 5*a* to 5*d* are connected to ink inflow ports 47*a* to 47*d* provided at one end of the ink supplying member 27 (opposite side of the ink inflow ports 41*a* to 41*d* in a plan view). The black ink (Bk) flows into the first chamber 27*a* from the ink inflow port 47*a* through a recess passage 48, and flows into the second chamber 27*b* through a passage 42. As shown in FIGS. 5A, 8B, and 9, the other color inks (cyan, magenta, and yellow) flow from the ink inflow ports 47*b* to 47*d*, through the recess passage 48 and a communicating passage 49 (formed such that the upper case 32 and the lower case 31 are connected), into the first chambers 28*a* to 30*a* formed in the upper case 31. After that, the inks flow into the second chambers 28*b* to 39*b* formed in the lower case 32 through a communicating hole 39.

A pressure fluctuation (pressure change, pressure wave) in each ink is absorbed (relaxed) by the flexible films 33 and 34 facing respectively. The ink supplying member 23 is fixed to the head holder 8, between the flexible film 33 and the bottom plate 8*a* of the head holder 8. A gap for a deformation (A gap to accommodate a deformation) of the flexible film 33 has been secured between the flexible film 33 and the base plate Ba of the head holder 8.

In the ink storage section 24 of such structure, air bubbles included in the ink are accumulated upon separation to float on an upper side of each of the second chambers 27*b* to 30*b*. Since an amount (the number) of air bubbles increases gradually, it is necessary to discharge the accumulated air bubbles to an outside. As shown in FIG. 8A, a plurality of exhaust holes 53 which communicate with an upper portion of each of the second chambers 27*b* to 30*b* is formed to penetrate the upper case 31, at positions corresponding to an upper side of each of the ink outflow ports 41*a* to 41*d*. Each of the exhaust holes 53 communicates with an end portion of an exhaust passage 51 which is formed independently as a recess (which is formed as a grove) in the upper surface of the upper case 31. The exhaust passage 51 is extended in the Y direction along the communicating portion 24*a*, and is connected to a passage hole 56 of the exhaust section 25. An upper surface of the passage hole 56 and the exhaust passage 51 is covered by the flexible film 34.

Exhaust holes 53 for the cyan ink (C), the yellow ink (Y), and the magenta ink (M) respectively are formed to cut through a cylindrical member (not shown in the diagram) which is suspended inside each of the second chambers 28*b* to 30*b*, from the upper case 31. When the air bubbles are discharged from the exhaust holes 53 as it will be described later, a predetermined amount of the air o is remained at the upper portion of each of the second chambers 28*b* to 30*b*. The predetermined amount corresponds to a height of the cylindrical member (corresponds to a volume of a space in the cylindrical member). In the exhaust holes 53, a predetermined amount of air is secured by providing the third chamber 27*c*. However, the exhaust hole 53 for the black ink may also be formed similarly as the exhaust hole 53 for the inks of other colors.

As shown in FIG. 8A, four passage holes 56 corresponding to the ink of each color, are formed in the exhaust section 25. The passage holes 56 are long in a vertical direction and open vertically. As shown in FIG. 2, a large diameter portion 56*a* is formed in an upper half of each passage hole 56, and a small diameter passage 56*b* is formed in a lower half of each passage hole 56. A lower end of the small diameter passage 56*b* is opened to an outside at almost the same plane as an opening (aperture) plane of the nozzles 4 of the ink-jet head 1. An exhaust valve 57 is inserted into the large diameter portion 56*a*, and a valve rod 58 of a small diameter which is pierced through the small diameter passage 56*b* is formed integrally in the exhaust valve 57. A packing 59 such as an O-ring for sealing, which is fitted on the valve rod 58, is arranged at a lower-end surface side of the exhaust valve 57. A lower end of the valve rod 58 is extended up to an area near an outer opening end of the small diameter passage 56*b*. The exhaust valve 57 is always pushed in downward direction by a spring mechanism 60 such as a coiled spring which is provided inside the large diameter portion 56*a*. In this state, the packing 59 is pushed to a bottom surface of the large diameter portion 56*a* of the passage hole 56, and the vale is in a closed state.

The maintenance unit 21 includes a cap member 76 which covers an opening (aperture) surface of the nozzles 4 of the ink-jet head 1 such that the opening surface can be opened and closed, and a plurality of small cap members 72 which cover individually an outer opening end of the exhaust section 25, in other words, an outer opening end of each small diameter passage 56*b*, such that the outer opening end can be opened and closed. When the carriage 3 has moved to a stand-by position (right-end position in FIG. 1), both the cap members 76 and 72 are made to ascend by a vertical movement mechanism 73 such that the both cap members 76 and 72 make a close contact with the opening surface of the nozzles 4 and the outer opening end of the exhaust section 26 (25), similarly as a known maintenance unit. At the time of moving the carriage 3 to another position, the both cap members 76 and 72 are made to descend to be isolated (separated) from the surface thereof.

Each of the small cap members 72 has a projection 72*a* (operating mechanism) which is projected farther than the small cap member 72. When the projection 72*a* makes a close contact with the outer opening end of the exhaust section 25, the projection 72*a* pushes up the valve rod 58 resisting a bias force of a spring means 60. Accordingly, the packing 59 is released from an inner bottom portion of the large diameter portion 56*a*, and the valve is in an open state. Moreover, each small cap member 72 is connected to a suction pump 74 which is a suction mechanism, via a common channel, and by driving the suction pump 74, the air bubbles accumulated in the second chambers 27*b* to 30*b* of each ink chamber are sucked and discharged collectively.

Moreover, the cap member 76 is connected to the suction pump 74 similarly as the known maintenance unit, and by driving the suction pump 74, the ink which is thickened, and impurities are sucked and removed.

The cap member 76 and the small cap member 72 are selectively connected to the suction pump by a switching valve 75. The cap member 76 and the small cap member 72 make a close contact with the outer opening end of the exhaust section 25 and the opening (aperture) surface of the nozzles 4 at the same time, by the vertical movement mechanism 73. Only ink suction from a nozzle 22, or only discharge of the air bubbles in the second chambers 27*b* to 30*b* may be carried out separately. Or, the discharge of the air bubbles in each of the second chambers 27*b* to 30*b* may be carried out individually by making each of the projections 72*a* to be independently movable. Moreover, instead of the suction operation of the suction pump 74 as described above, by applying a positive pressure to the ink from a side of the ink tank 5, the ink which is thickened and impurities may be removed by pushing from the nozzle 22, and the air bubbles in the second chambers 27*b* to 30*b* may be discharged. Or, the suction operation and applying the positive pressure to the ink may be used together in combination.

In the ink-jet recording apparatus 100 of the abovementioned structure, the exhaust section 25 may be arranged integrally side by side at a side portion of the ink storage section 24 in the ink supplying member 23 which is mounted on the head holder 8. Since the space 26 is formed between the ink storage section 24 and the exhaust section 25, it is possible to connect the FFC 12R of the ink supplying member 23, which is drawn toward the exhaust section 25, to the circuit board 22 through the space portion 26. Accordingly, it is possible to match the length of the FFC 12R with the length of the FFC 12L of the ink supplying member, which is drawn toward the side opposite to the exhaust section 25. Therefore it is possible to suppress an unevenness in electrical characteristics of the two FFCs 12L and 12R. Moreover, it is possible to shorten a wiring length of the FFCs, and to reduce a cost of the FFCs 12L and 12R.

Moreover, since the outer opening end of the exhaust section 25 opens at a position away from the FFC 12R, it is possible to separate (disengage) easily the small cap member 72 and the projection 72*a* from the outer opening end of the exhaust section 25 without a fear of interference of the FFC 12R with the small cap member 72 and the projection 72*a*. Moreover, there is no fear that the ink discharged along with the air bubbles from the outer opening end of the exhaust section 25 causes an electric short-circuit of the terminals of the FFC.

Moreover, a shifted portion in which a central axis of the cable is shifted in the width direction is formed in a middle portion in the longitudinal direction of the FFC 12R, such that the FFC 12R passing through the space 26 does not make a contact with the connecting portion 24*a* between the ink storage section 24 and the exhaust section 25. Therefore, the FFC 12R is not required to be twisted or bent to pass through the space portion 26, and wiring becomes easy.

In this embodiment, the portion in between the FFC 12R (the middle portion of the FFC 12R) is shifted. However, the other end of the FFC 12R, on the side of the circuit board 22 may be shifted in the width direction according to a positional relationship of the piezoelectric actuator 11 and the circuit board 22 in a plan view.

Moreover, in the FFCs 12L and 12R, since the two cables namely the first cable 121 and the second cable 122 are connected in the longitudinal direction, it is possible to handle the ink-jet head with a short cable length without connecting the first cable 121 and the second cable 122 in a manufacturing process prior to fixing the ink-jet head 1 to the head holder 8. Consequently, a fear that the cable is hung during the operation is reduced, and it is possible to prevent the FFC 12 from getting disconnected electrically, and detached from the piezoelectric actuator 11.

What is claimed is:

1. An ink-jet recording apparatus which jets droplets of an ink onto a recording medium, comprising:

an ink-jet head which selectively jets the droplets of the ink, including a cavity unit in which a cavity and a plurality of nozzles which communicate with the cavity are formed, and an actuator which applies a jetting pressure to the ink in the cavity;

a circuit board on which an electric circuit which is electrically connected to the actuator is formed, the circuit board being arranged on the ink-jet head on a side opposite to the nozzles;

an ink supplying unit which is arranged between the ink-jet head and the circuit board, the ink supplying unit including an ink storage section which stores the ink to be supplied to the ink-jet head, an exhaust section which is connected to the ink storage section to remove air bubbles generated in the ink stored in the ink storage section, and a space formed in the ink supplying unit penetrating therethrough from a side of the ink-jet head of the ink supplying unit up to the circuit board, the space being formed between the ink storage section and the exhaust section; and two flexible flat cables which connect the actuator and the circuit board, the flexible flat cables including a first flexible flat cable which is wired to pass along a side, of the ink storage section, opposite to the exhaust section, and a second flexible flat cable which is drawn from the actuator to the other side, of the ink storage section, opposite to the first flexible flat cable to be wired to pass through the space.

2. The ink-jet recording apparatus according to claim 1, further comprising a head holder which is substantially box shaped and which holds the ink-jet head, the ink supplying unit, and the circuit board, the ink-jet head and the circuit board being held so as to overlap with each other in a plan view, wherein the exhaust section has an outer opening which is opened to outside of the ink supplying unit, at a side opposite to the ink storage section with respect to the second flexible flat cable.

3. The ink-jet recording apparatus according to claim 2, further comprising a suction mechanism which is provided outside of the head holder, which is detachable from the outer opening of the exhaust section, and which sucks air bubbles from the ink storage section when the suction unit is in closely contact with the outer opening.

4. The ink-jet recording apparatus according to claim 2, wherein each of the flexible flat cables has a flat portion which is joined to the actuator, and a flexible portion which is continuous to the flat portion and on which a chip circuit which drives the actuator is mounted;

the head holder has a bottom plate in which the ink-jet head is fixed to one surface thereof, and in which slit holes each for drawing the flexible portion of one of the flexible flat cables toward a rear-surface side of the bottom plate are formed for the flexible portions respectively; and a plurality of heat sinks which is disposed on a side of the other surface of the base plate, and which makes a contact with the chip circuit disposed on the flexible portion, the heat sinks corresponding to the flexible flat cables and guiding the flexible portion of the flexible flat cables to the circuit board; and a heat sink, among the heat sinks, corresponding to the second flexible flat cable is provided along the space.

5. The ink-jet recording apparatus according to claim 2, wherein the flexible flat cables have a belt shape, and the space is formed as a slit of which cross section corresponds to a cross section of the belt shaped flexible flat cables.

6. The ink-jet recording apparatus according to claim 5, wherein the ink supplying unit includes a connecting portion connecting the ink storage chamber and the exhaust section, the connecting portion partially overlapping in a plan view with an extending area in which the second flexible flat cable is extended in a longitudinal direction thereof, and which has a width at a position, of the second flexible flat cable, at which the second flexible flat cable is drawn from the actuator; and the second flexible flat cable is formed to be belt shaped, which is shifted at an intermediate portion or at an end portion in a width direction of the second flexible flat cable to avoid the connecting portion.

7. The ink-jet recording apparatus according to claim 2, wherein the flexible flat cables include a plurality of cables connected in a longitudinal direction of the cables.

8. The ink-jet recording apparatus according to claim 1, further comprising:

an exhaust valve which is provided on the exhaust section, and which connects and disconnects an outside of the ink supplying unit and the ink storage section through the outer opening; and an operating mechanism which is provided outside of the head holder, and which operates the exhaust valve.

9. The ink-jet recording apparatus according to claim 1, wherein the actuator has a first actuator and a second actuator, and one end of the first flexible flat cable is connected to the first actuator, and one end of the second flexible flat cable is connected to the second actuator.

10. The ink-jet recording apparatus according to claim 1, wherein the first flexible flat cable and the second flexible flat cable have mutually different shapes.

11. The ink-jet recording apparatus according to claim 10, wherein the first flexible flat cable and the second flexible flat cable have shifted portions shifted toward one side in a width direction of the flexible flat cables respectively, and the shifted portion of the second flexible flat cable is shifted to an extent greater than that of the shifted portion of the first flexible flat cable.

* * * * *